US009452335B2

(12) United States Patent
Vanderberg

(10) Patent No.: US 9,452,335 B2
(45) **Date of Patent: *Sep. 27, 2016**

(54) LIGHT-UP SHUFFLEBOARD EQUIPMENT

(71) Applicant: M & C INNOVATIONS, LLC, Charlotte, NC (US)

(72) Inventor: Matthew Alexander Vanderberg, Charlotte, NC (US)

(73) Assignee: M & C INNOVATIONS, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/320,412

(22) Filed: Jun. 30, 2014

(65) Prior Publication Data

US 2015/0130130 A1 May 14, 2015

Related U.S. Application Data

(63) Continuation of application No. 13/194,494, filed on Jul. 29, 2011, now Pat. No. 8,764,592.

(60) Provisional application No. 61/369,465, filed on Jul. 30, 2010.

(51) Int. Cl.
*A63B 67/14* (2006.01)

(52) U.S. Cl.
CPC ..... *A63B 67/14* (2013.01); *A63B 2207/02* (2013.01)

(58) Field of Classification Search
CPC ..... A63B 67/14; A63B 2207/02
USPC ..... 473/588
See application file for complete search history.

(56) References Cited

U.S. PATENT DOCUMENTS

| | | | | |
|---|---|---|---|---|
| 2,606,030 | A * | 8/1952 | Tjomsland | 473/588 |
| 3,102,727 | A * | 9/1963 | Rice | 473/570 |
| 4,183,536 | A * | 1/1980 | Platt | 473/570 |
| 4,846,475 | A * | 7/1989 | Newcomb et al. | 473/570 |
| 4,968,036 | A * | 11/1990 | Von Der Mark | 473/570 |
| 6,126,561 | A * | 10/2000 | Mark | 473/588 |
| 7,621,833 | B2 * | 11/2009 | Proulx et al. | 473/588 |
| 8,764,592 | B2 * | 7/2014 | Vanderberg | 473/588 |
| 2003/0119613 | A1 * | 6/2003 | Samuel et al. | 473/588 |
| 2004/0220001 | A1 * | 11/2004 | Oister et al. | 473/570 |
| 2007/0275801 | A1 * | 11/2007 | Proulx et al. | 473/588 |
| 2012/0025459 | A1 * | 2/2012 | Vanderberg | 273/126 A |
| 2012/0025460 | A1 * | 2/2012 | Vanderberg | 273/129 L |

* cited by examiner

*Primary Examiner* — Raleigh W Chiu
(74) *Attorney, Agent, or Firm* — Tillman Wright, PLLC; Chad D. Tillman; Jeremy C. Doerre

(57) ABSTRACT

A light-up shuffleboard disc includes a lighting component, and a disc component with a cavity for receiving the lighting component. The disc component is constructed so as to allow light from the lighting component to illuminate the shuffleboard disc when the lighting component is received within the cavity of the disc component. A light-up shuffleboard set includes a light-up shuffleboard court, and a plurality of light-up shuffleboard discs.

14 Claims, 4 Drawing Sheets

20

20

20

LIGHT-UP SHUFFLEBOARD EQUIPMENT

CROSS-REFERENCE TO RELATED APPLICATION

The present application is a U.S. continuation patent application of, and claims priority under 35 U.S.C. §120 to, U.S. nonprovisional patent application Ser. No. 13/194,494, filed Jul. 29, 2011, which patent application and any patent application publications thereof are incorporated by reference herein, and which patent application is a U.S. nonprovisional patent application of, and claims priority under 35 U.S.C. §119(e) to, U.S. provisional patent application Ser. No. 61/369,465, filed Jul. 30, 2011, which provisional patent application is hereby incorporated herein by reference.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to light-up shuffleboard equipment.

Shuffleboard is a well known game. As anyone who has ever tried will know, however, it can be challenging to play shuffleboard when it is dark.

A need exists for improvement in shuffleboard equipment. This, and other needs, are addressed by one or more aspects of the present invention.

SUMMARY OF THE INVENTION

The present invention includes many aspects and features. Moreover, while many aspects and features relate to, and are described in, the context of light-up shuffleboard equipment, the present invention is not limited to use only in this context, as will become apparent from the following summaries and detailed descriptions of aspects, features, and one or more embodiments of the present invention.

Accordingly, one aspect of the present invention relates to a light-up shuffleboard disc. The light-up shuffleboard disc includes a lighting component, and a disc component including a cavity for receiving the lighting component. The disc component is constructed so as to allow light from the lighting component to illuminate the shuffleboard disc when the lighting component is received within the cavity of the disc component.

In a feature of this aspect, the disc component is configured to retain the lighting component within the cavity.

In a feature of this aspect, the disc component is configured to retain the lighting component within the cavity via threaded engagement of walls of the cavity with an outer portion of the lighting component.

In a feature of this aspect, the cavity includes a recess proximate a bottom thereof In a feature of this aspect, the lighting component includes a light source, and wherein the recess of the disc component is sized and dimensioned to accommodate the light source when the lighting component is fully received within the cavity of the disc component.

In a feature of this aspect, a bottom of the cavity is partially defined by a planar surface, and wherein, when the lighting component is fully received within the cavity of the disc component, an activation button of the lighting component is depressed via contact with the planar surface, thereby activating the light source of the lighting component.

In a feature of this aspect, the lighting component comprises an incandescent light bulb.

In a feature of this aspect, the lighting component comprises a light emitting diode (LED) bulb.

In a feature of this aspect, the lighting component comprises a fluorescent bulb.

In a feature of this aspect, the shuffleboard disc is configured to be transitioned between a first state in which the lighting component is fully received within the cavity and the lighting component is activated and a second state in which the lighting component is not fully received within the cavity and the lighting component is not activated.

Another aspect of the present invention relates to a light-up shuffleboard disc as disclosed.

Another aspect of the present invention relates to a light-up shuffleboard disc.

Another aspect of the present invention relates to a method of activating a light-up shuffleboard disc as disclosed.

Another aspect of the present invention relates to a method of deactivating a light-up shuffleboard disc as disclosed.

Another aspect of the present invention relates to a method of using a light-up shuffleboard disc.

Another aspect of the present invention relates to a light-up shuffleboard court.

Another aspect of the present invention relates to a method of using a light-up shuffleboard court.

Another aspect of the present invention relates to a light-up shuffleboard set that includes a light-up shuffleboard court, and a plurality of light-up shuffleboard discs.

Another aspect of the present invention relates to a light-up shuffleboard set.

Another aspect of the present invention relates to a method of using a light-up shuffleboard set.

In addition to the aforementioned aspects and features of the present invention, it should be noted that the present invention further encompasses the various possible combinations and subcombinations of such aspects and features.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1:
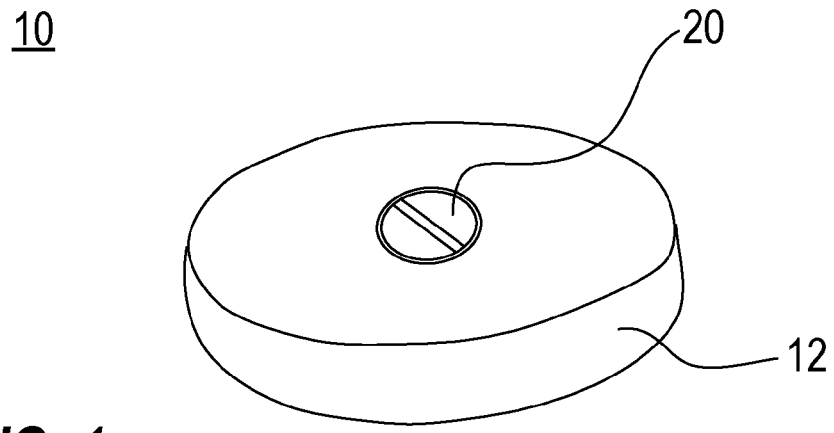
FIGS. 1-3 illustrates an embodiment of a light-up shuffleboard disc in accordance with one or more aspects of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Turning now to the figures, FIG. 1 illustrates an embodiment of a light-up shuffleboard disc 10 in accordance with one or more aspects of the present invention. In one or more preferred implementations, the light-up shuffleboard disc 10 preferably is dimensioned in accordance with standard shuffleboard discs. For example, in a preferred implementation, the light-up shuffleboard disc 10 the disc is 6 inches in diameter, 9/16 inch to 1 inch thick, and weighs 15 ounces when new. In preferred implementations, this weight takes into account all of the components described herein. In at least some preferred implementations, the shuffleboard disc 10 is thicker than 1 inch to accommodate components contained therein.

The light-up shuffleboard disc 10 comprises a disc component 12 and a lighting component 20. The lighting component 20 is configured to illuminate the shuffleboard disc 10 when received within a cavity 14 of the disc component 12. Specifically, the disc component 12, and/or an outer shell portion of the lighting component 20, are preferably constructed to be partially, or wholly, transparent or translucent so as to allow light from the lighting component 20 to be visible from an exterior of the shuffleboard disc 10 when the lighting component 20 is received within the cavity 14. In one or more preferred implementations, the disc component 12 is at least partially constructed from a material configured to fluoresce in response to light.

Figure 2:
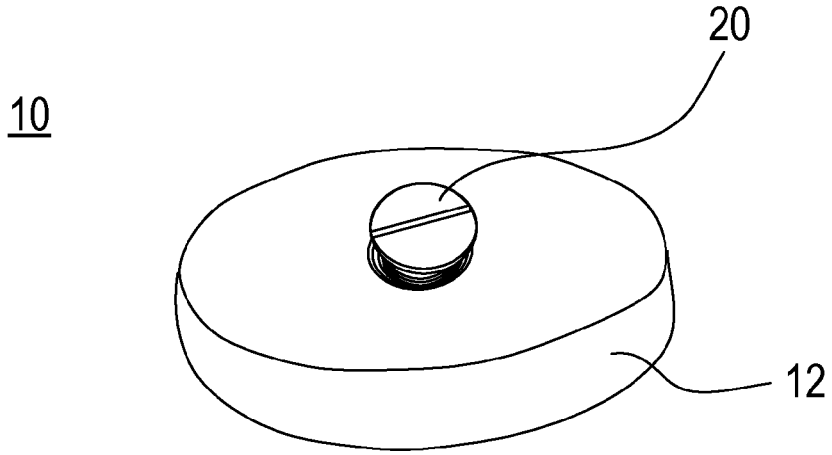
Figure 3:
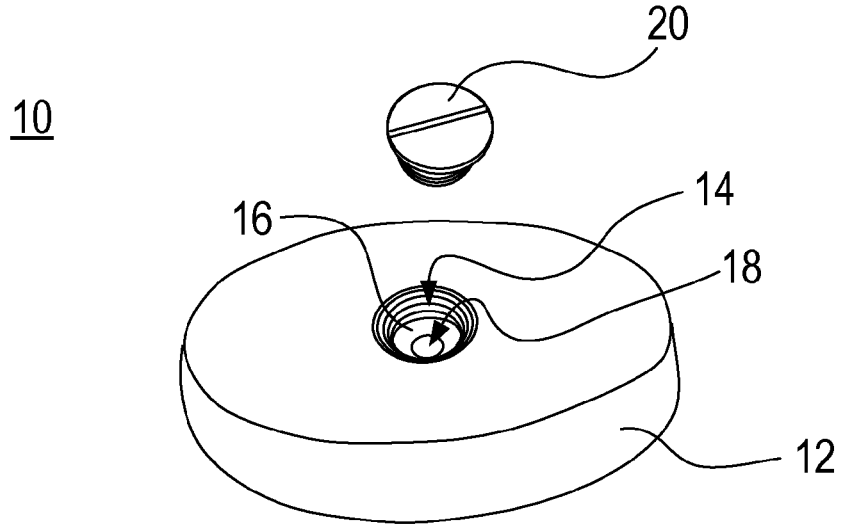

Walls of the cavity 14 are preferably configured for threaded engagement with an outer portion of the lighting component 20 such that the lighting component 20 is capable of being removably secured within the cavity 14, as illustrated via FIGS. 1-3.

FIG. 1 illustrates the shuffleboard disc 10 in a first state in which lighting component 20 is fully received within cavity 14. In this state, the shuffleboard disc 10 can be characterized as being ready for play. From this state, the lighting component 20 can be removed via unscrewing of the lighting component 20 relative to the disc component 12. Such unscrewing could be utilized to effect transition from the state illustrated in FIG. 2, to the state illustrated in FIG. 2, in which the lighting component 20 is only partially received within the cavity 14. Further unscrewing could then be utilized to effect transition to the state illustrated in FIG. 3, in which the lighting component 20 has been entirely removed from the cavity 14.

Figure 4:
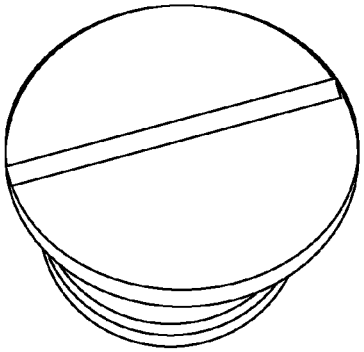
FIG. 4 is an enlarged perspective view of a top of the lighting component of the shuffleboard disc of FIGS. 1-3.

FIG. 4 is an enlarged perspective view of a top of the lighting component 20. As illustrated, the top of the lighting component 20 preferably includes a screw cut which could be engaged, for example, by a slotted screwdriver or a coin for screwing or unscrewing the lighting component 20 into or out of the cavity 14 of the disc component 12.

Figure 5:
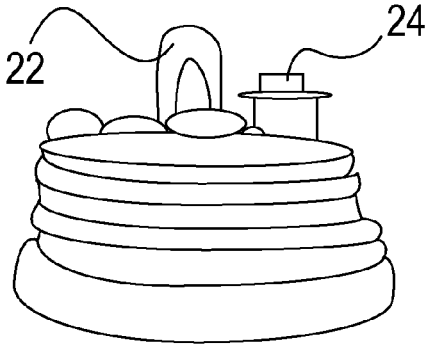
FIG. 5 is a side perspective view of the lighting component of FIG. 4 after it has been oriented upside down relative to the position in which it was illustrated in FIG. 4.
Figure 6:
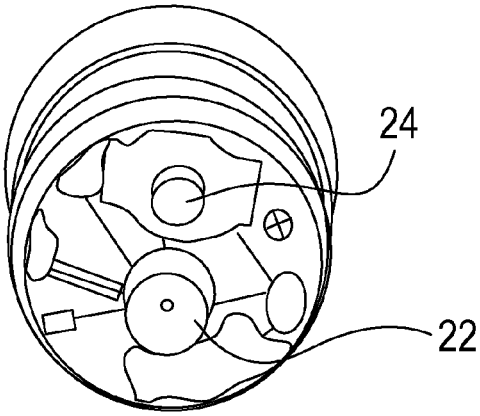
FIG. 6 is a perspective view of a bottom of the lighting component of FIG. 4.

FIG. 5 is a side perspective view of the lighting component 20 of FIG. 4 after it has been oriented upside down relative to the position in which it was illustrated in FIG. 4, and FIG. 6 is a perspective view of a bottom of the lighting component 20 of FIG. 4. As illustrated in FIGS. 5 and 6, the lighting component 20 preferably includes electronics including a light source 22 and a depressable button 24 configured for activation or deactivation of the light source 22.

The light source 22 preferably comprises an incandescent light bulb, although in at least some alternative implementations the light source 22 may comprise a light emitting diode (LED) light bulb, a fluorescent bulb, or some other type of bulb. In at least some implementations, the lighting component may comprise a non-bulb light source.

Preferably, the button 24 is configured to activate (turn on) the light source 22 when depressed, but in at least some other preferred implementations the lighting component 20 is configured such that the light source 22 is activated (on) unless the button 24 is depressed.

Figure 8A:
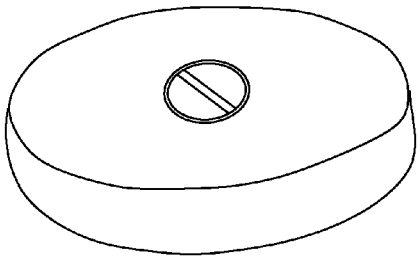
FIG. 8A illustrates the shuffleboard disc of FIGS. 1-3 in a state in which its lighting component is fully received within its cavity.
Figure 8B:
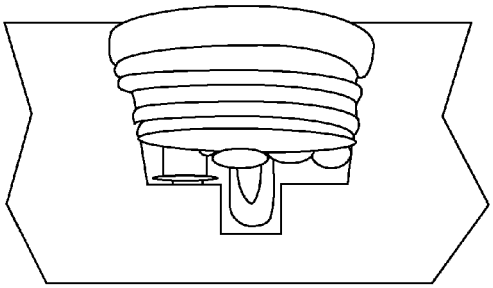
FIG. 8B is a fragmented partial cut-away view of the shuffleboard disc of FIG. 8A illustrating the depression of a button of a lighting component by a planar surface at the bottom of a cavity of the shuffleboard disc.

As illustrated in FIG. 3, the cavity 14 of the disc component 12 preferably includes a recess 18 defined in a planar surface 16 that itself partially defines a bottom of the cavity 14. The recess 18 is configured to accommodate the light source 22 of the lighting component 20 when the lighting component 20 is received and retained within the cavity 14, as illustrated in FIG. 8B.

It will be appreciated from the description hereinabove with respect to FIGS. 1-3 that the depth of the lighting component 20 within the cavity 14 is adjustable by screwing or unscrewing the lighting component 20 with respect to the disc component 12. The cavity 14 and lighting component 20 are sized and dimensioned such that, when the lighting component 20 is fully received within the cavity 14, the button 24 of the lighting component 20 is depressed by the planar surface 16 at the bottom of the cavity 14. FIG. 8A illustrates the shuffleboard disc 10 in this state when the lighting component 20 is fully received within the cavity 14, and FIG. 8B is a fragmented partial cut-away view illustrating depression of the button 24 by the planar surface 16 at the bottom of the cavity 14 in this state.

Figure 7A:
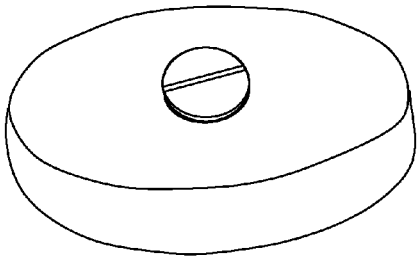
FIG. 7A illustrates the shuffleboard disc of FIGS. 1-3 in a state in which its lighting component is close to, but not quite, fully received within its cavity.
Figure 7B:
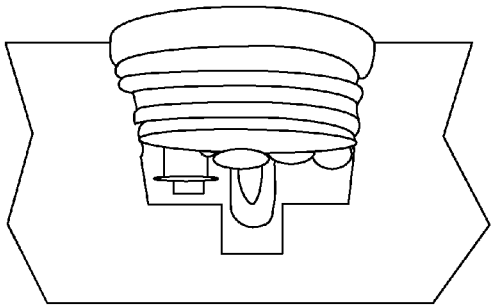
FIG. 7B is a fragmented partial cut-away view of the shuffleboard disc of FIG. 7A illustrating the lack of depression of a button of a lighting component by a planar surface at the bottom of a cavity of the shuffleboard disc.

By way of contrast, FIG. 7A illustrates the shuffleboard disc 10 in a state in which the lighting component 20 is close to, but not quite, fully received within the cavity 14, and FIG. 7B is a fragmented partial cut-away view illustrating lack of depression of the button 24 by the planar surface 16 at the bottom of the cavity 14 in this state.

Thus, the shuffleboard disc 10, in implementations in which depression of the button 24 is configured to effect activation of the light source 22, is configured such that a user can transition the shuffleboard disc 10 to a lighted state by fully screwing in lighting component 20 into cavity 14.

One or more implementations of a light-up shuffleboard disc have been described hereinabove wherein a lighting component is received and retained within a cavity via threaded engagement. In at least some alternative implementations, however, a lighting component is received and retained within a cavity in another manner, such as, for example, via a snap-fit connection. Further, in at least some implementations, a shuffleboard disc is configured to include a light source disposed therein that is not a part of an easily removable lighting component. In at least some such preferred implementations, the shuffleboard disc is configured such that a battery and/or a light source contained within the shuffleboard disc can be easily changed.

Figure 9:
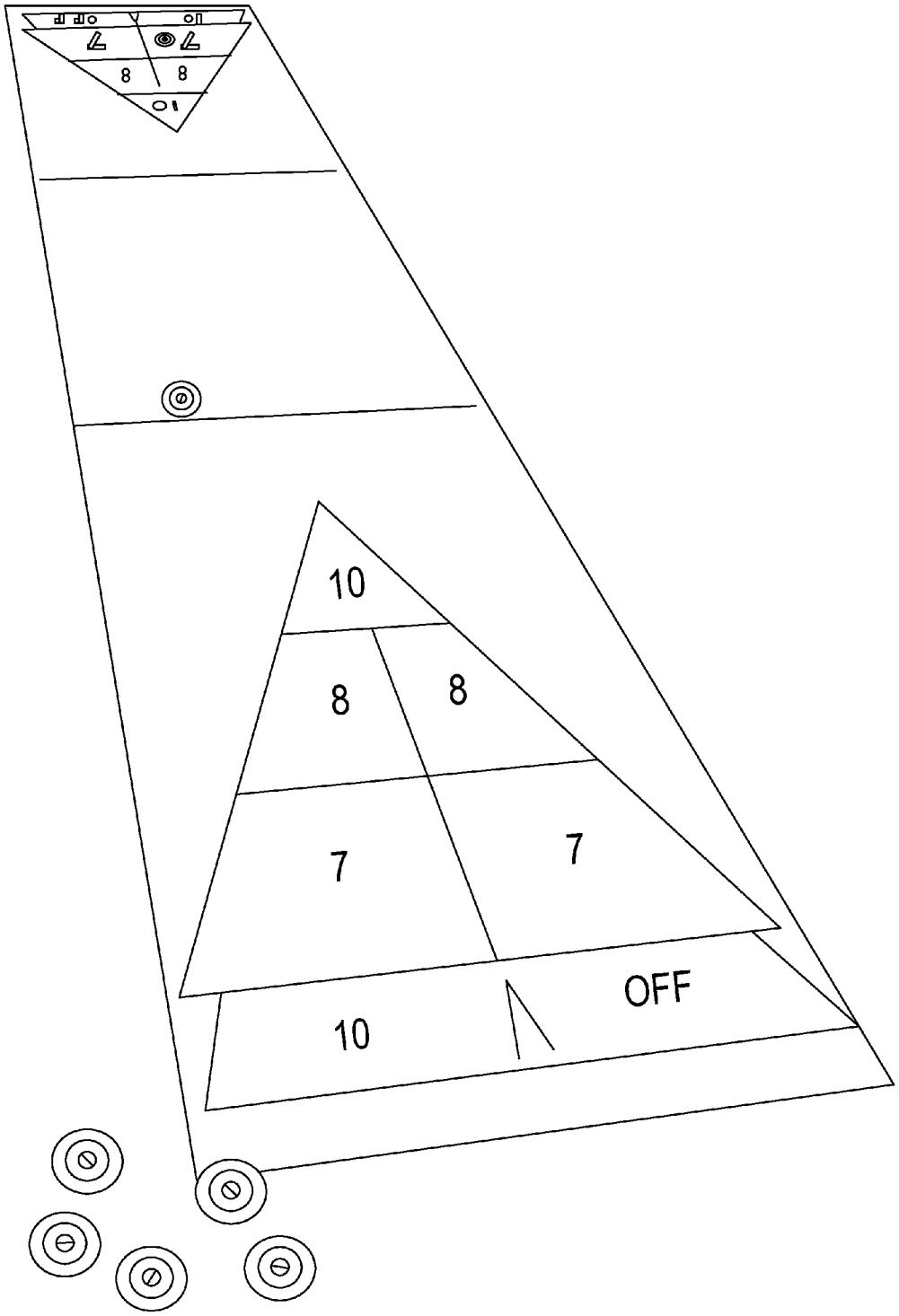
FIG. 9 illustrates an embodiment of a light-up shuffleboard court in accordance with one or more aspects of the present invention.

In preferred methods in accordance with one or more aspects of the present invention, a light-up shuffleboard disc is utilized in combination with a light-up shuffleboard court. FIG. 9 illustrates an embodiment of a light-up shuffleboard court in accordance with one or more aspects of the present invention.

Preferably, one or more sections of the light-up shuffleboard court are configured to light-up, for example, to facilitate play in the dark. In at least some preferred implementations, incandescent lighting technology, fluorescent lighting technology, and/or LED lighting technology are utilized to light the light-up the shuffleboard court.

In at least some preferred implementations, the shuffleboard court and one or more shuffleboard discs are configured such that lighting up of one or both will be effected based on placement of the shuffleboard disc on a certain section of the shuffleboard court.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A light-up gaming disc, comprising:

(a) a lighting component; and (b) a disc component including a cavity for receiving the lighting component;

(c) wherein the cavity includes a recess proximate a bottom thereof; and (d) wherein the disc component is constructed so as to allow light from the lighting component to illuminate the gaming disc when the lighting component is received within the cavity of the disc component.

2. The light-up disc of claim 1, wherein the disc component is configured to retain the lighting component within the cavity.

3. The light-up disc of claim 2, wherein the disc component is configured to retain the lighting component within the cavity via threaded engagement of walls of the cavity with an outer portion of the lighting component.

4. The light-up disc of claim 1, wherein the lighting component includes a light source, and wherein the recess of the disc component is sized and dimensioned to accommodate the light source when the lighting component is fully received within the cavity of the disc component.

5. The light-up disc of claim 4, wherein a bottom of the cavity is partially defined by a planar surface, and wherein, when the lighting component is fully received within the cavity of the disc component, an activation button of the lighting component is depressed via contact with the planar surface, thereby activating the light source of the lighting component.

6. The light-up disc of claim 1, wherein the lighting component comprises an incandescent light bulb.

7. The light-up disc of claim 1, wherein the lighting component comprises a light emitting diode (LED) bulb.

8. The light-up disc of claim 1, wherein the lighting component comprises a fluorescent bulb.

9. The light-up disc of claim 1, wherein the shuffleboard disc is configured to be transitioned between a first state in which the lighting component is fully received within the cavity and the lighting component is activated and a second state in which the lighting component is not fully received within the cavity and the lighting component is not activated.

10. A method for activating a light-up gaming disc comprising the steps of:

inserting a lighting component, comprising a light source, into a cavity of a gaming disc;

removably securing the lighting component within the cavity, such that the lighting component is fully received within the cavity;

wherein the light source is activated within the cavity when the lighting component is fully received within the cavity;

wherein walls of the cavity are configured for threaded engagement with an outer portion of the lighting component.

11. The method of claim 10, wherein removably securing the lighting component includes screwing the lighting component into the cavity.

12. The method of claim 11, wherein a bottom of the cavity is partially defined by a planar surface, and wherein, when the lighting component is fully received within the cavity of the disc, an activation button of the lighting component is depressed via contact with the planar surface, thereby activating the light source of the lighting component.

13. The method of claim 10, wherein the light source is one of an incandescent light bulb, a light emitting diode, and a fluorescent bulb.

14. The method of claim 10, wherein the disc is translucent so as to allow light from the lighting component to be visible from an exterior of the disc when the light source is activated.

* * * * *